US005142322A

United States Patent [19]

Surti

[11] Patent Number: 5,142,322

[45] Date of Patent: Aug. 25, 1992

[54] ELECTROPHOTOGRAPHIC COPIER PROCESS KIT HAVING SUPPORT BRACKETS FOR PROVIDING DISASSEMBLY OF INTERNAL PROCESS COMPONENTS

[76] Inventor: Tyrone N. Surti, 424 Harding Industrial Dr., Nashville, Tenn. 37211

[21] Appl. No.: 177,920

[22] Filed: Apr. 5, 1988

[51] Int. Cl.[5] ..... G03G 15/00

[52] U.S. Cl. ..... 355/200; 355/211

[58] Field of Search ..... 355/3 R, 3 DD, 133, 355/200, 210, 211, 245, 296

[56] References Cited

U.S. PATENT DOCUMENTS

| | | | |
|---|---|---|---|
| 3,667,840 | 6/1972 | Engel et al. | 355/3 DR |
| 3,689,146 | 9/1972 | Ito et al. | 355/3 DR X |
| 4,538,896 | 9/1985 | Tajima et al. | 355/3 DD X |
| 4,708,455 | 11/1987 | Kubota et al. | 355/3 DR X |
| 4,965,633 | 10/1990 | Surti | 355/200 |

FOREIGN PATENT DOCUMENTS

| | | | |
|---|---|---|---|
| 0118769 | 6/1986 | Japan | 355/3 R |

*Primary Examiner*—A. T. Grimley
*Assistant Examiner*—Robert Beatty
*Attorney, Agent, or Firm*—C. A. Phillips

[57] ABSTRACT

A process kit for use in an image-forming apparatus. The process kit includes a development device, a corona discharger, and a cleaning device disposed in spaced relation around the periphery of a photosensitive drum. Each of the above-mentioned components, including the drum, are releasably mounted in a primary housing which is disposed for insertion into the image-forming apparatus. A bracket is disposed at the opposite ends of the development device, corona discharger, cleaning device, and photosensitive drum to releasably secure these components in the primary housing in a manner which provides access for refurbishment or replacement.

2 Claims, 7 Drawing Sheets

ELECTROPHOTOGRAPHIC COPIER PROCESS KIT HAVING SUPPORT BRACKETS FOR PROVIDING DISASSEMBLY OF INTERNAL PROCESS COMPONENTS

FIELD OF THE INVENTION

This invention relates generally to process kits for imageforming devices and more particularly to such process kits having process means for acting on an image-bearing member to perform an image-forming process, the components of the process means being releasably mounted to permit individual refurbishment or replacement thereof.

BACKGROUND OF THE INVENTION

Electrophotographic copying apparatus typically includes a photosensitive member, such as a drum, as an image bearing member, a corona wire, a developer including a toner, and a cleaning device for cleaning residual toner left on the drum and for storing the removed toner. After a period of use, servicing of the various parts are required. In the past, such servicing required a serviceman to go to the user's office to interchange, adjust, or clean these various components.

Recently, however, in order to eliminate the requirement for a serviceman, kits have been constructed in which the photosensitive drum, the developing device, cleaning device, and corona discharger have been made into a unitary structure. Such unitary structures are disclosed in U.S. Pat. Nos. 4,575,221, and 3,985,436 incorporated herein. These unitary structures are provided so that the need for a serviceman is eliminated.

The structure of each of the above process kits requires that it be thrown away if any one of the components are expended. That is, for example, if the toner in the developing device has been depleted, it is required that the toner and all other internal components of the developing device (which includes a cylindrical development sleeve, a magnetic roller, and a magnetic blade) be thrown away. In addition to discarding the complete development device, it is necessary to discard the photosensitive drum, the complete cleaning device (with wiper blade, etc.) the corona discharger and mounting assemblies, and the housing with all of its appurtenances, such as alignment pins, electrical connectors, counting mechanism, etc. Obviously, such complete replacement of parts is not only unnecessary but also undesirable from a cost standpoint.

Applicant provides a structure wherein any of the above-mentioned processing components may be individually serviced or replaced, thus eliminating the need for purchasing unneeded parts. Additionally, applicant has provided such a structure in which the internal components are made readily accessible for facile servicing or replacement of individual components by an operator, thus eliminating the delays and expenses incurred when relying on a serviceman.

It is, therefore, an object of the present invention to provide a process kit for an electrophotographic image-forming apparatus in which any single component of various process means may be serviced or replaced in an inexpensive and facile manner without requiring the service of a serviceman.

DESCRIPTION OF THE PREFERRED EMBODIMENT

Figure 1:
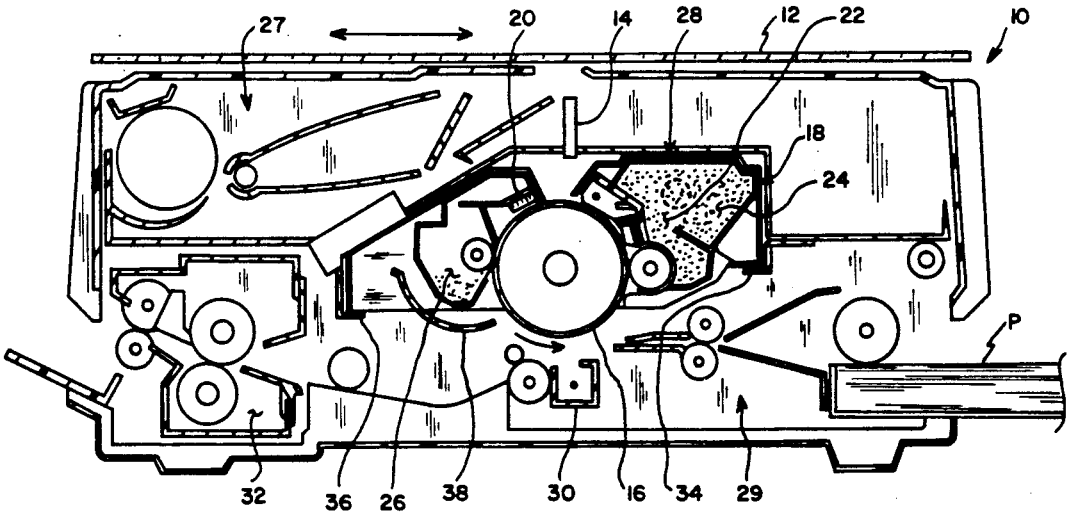
FIG. 1 is a cross-sectional view of a copying machine in which a process kit of the present invention is mounted.

As seen in FIG. 1, an electrophotographic copying machine 10 comprises a transparent table 12 movable in directions indicated by the arrow. An original which is to be reproduced is placed on table 12. Typically, an array of image-forming elements 14 is arranged to expose an image of the original document to a photosensitive drum 16 which is rotatable in the direction shown by the arrow. As is well known, the drum typically includes a photosensitive OPC layer and an electrically conductive substrate. An assembly or unit 18, known in the art as a process kit, is releasably mounted in the copying machine. The process kit 18 includes a corona discharger 20 for uniformly charging the photosensitive drum 16, a development device 22 having a toner 24 therein for developing an electrostatic latent image which has been formed on the drum 16 through optical array 14. A cleaning device 26 is also mounted in a primary housing 28 of process kit 18 and spaced from development device 22 around the periphery of photosensitive drum 16. A counter 31 is secured to an end of primary housing 28. Such counters are well known in the art, one being disclosed in the above-identified U.S. Pat. No. 4,575,221.

Machine 10 includes upper and lower assemblies 27 and 29, and lower assembly 29 includes various rollers and other assemblies which cooperate in moving a transfer sheet P past drum 16 for fixing the toner image on the sheet in a manner well known in the art. As is also known, as the drum rotates, a toner is placed thereon; and when sheet P reaches the drum, the toner image is transferred from the drum to sheet P by a transfer charger 30 carried in machine 10. The sheet is then moved through a fixer 32 also mounted on machine 10 where the toner image is fixed to sheet P. Some toner remains on the drum, and this remaining toner is collected and stored in cleaning device 26.

Figure 6:
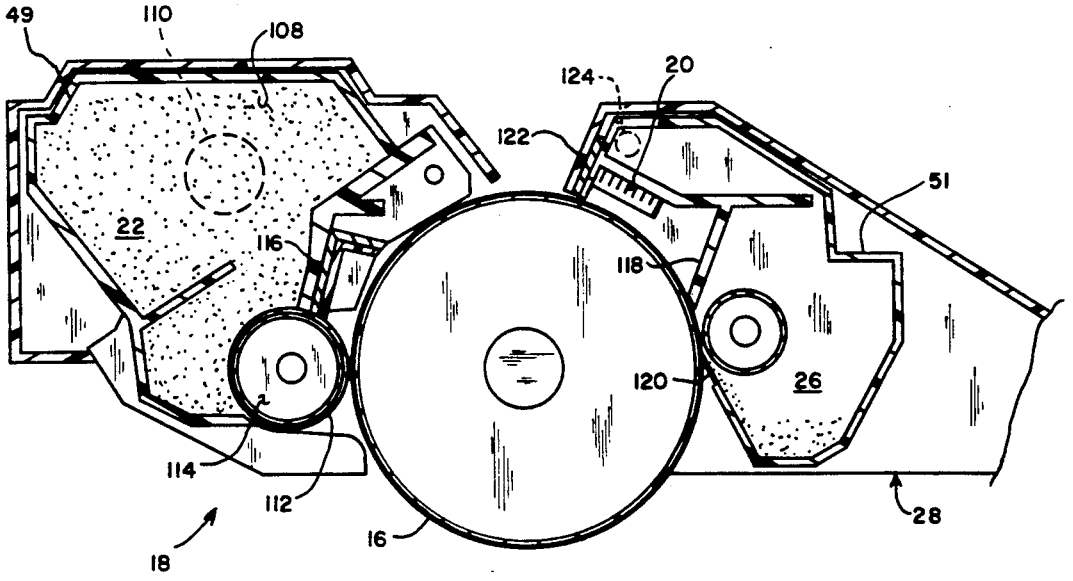
FIG. 6 is an enlarged sectional view taken along line 6—6 of FIG. 2 illustrating the positions of the developing device, cleaning device, corona discharger, and drum.

As can be seen in FIGS. 1 and 6, housing 28 encloses the development device 22, corona discharger 20, and cleaning device 26 around drum 16 and also forms a light shielding wall that is separate from the upper and lower housings of machine 10. The process kit is releasably mounted in machine 10 along rails 34 and 36 located in machine 10.

A protective cover 38 of opaque material is provided and serves as a light shielding member for the exposed surface of the photosensitive member even when the machine is in its open position. The cover is rotatably supported by a rotatable shaft (now shown) and is biased by a spring (not shown) to a closed position. An actuating lever (not shown) is actuated by a projection in the machine 10 for actuation of the cover in a manner known in the art.

If an operator desires to remove the process kit, the upper housing of machine 10 is swung upwardly to an open position. Process kit 18 is then moved along rails 34 and 36 along the axis of drum 16. As the process kit is removed, the exposed portion of drum 16 is shielded from the external light by cover 38. A second light shielding cover 39 (FIG. 2) protects drum 16 from any light entering an opening near the top peripheral surface of the photosensitive drum adjacent light array 14. Also, the process kit may include an opening for directing a light for pre-exposure to the portion of photosensitive drum 16 between the corona discharger 20 and cleaning device 26. Such pre-exposure light passage structure and second light shielding cover are well known in the art and may be similar to that described in U.S. Pat. No. 4,575,221.

Figure 2:
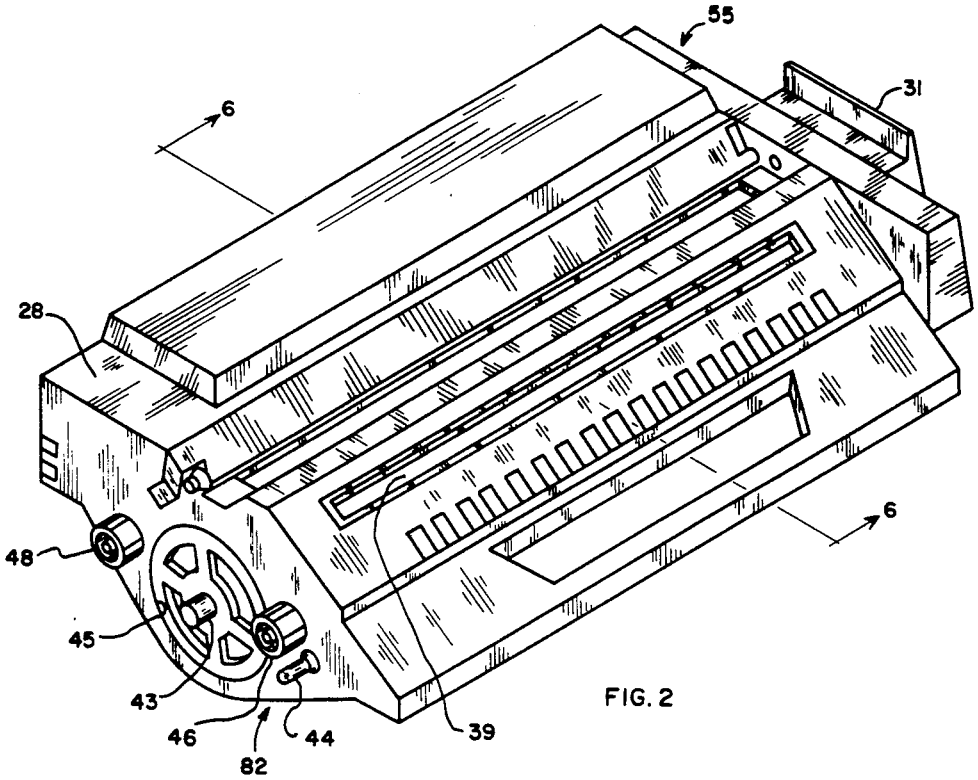
FIG. 2 is a pictorial view of a process kit housing in which the support structure of the present invention may be mounted to provide accessability to the individual processing components in the housing for servicing thereof.

As shown in FIG. 2, housing 28 of process kit 18 is provided with a pin 44 for properly positioning the process kit in the machine, an electrical connector 46 for supplying charger 20 with a high voltage, and a connector 48 for applying a bias voltage to development device 22. Additional positioning means may be provided between the machine and the housing wall opposite the wall on which pin 44 is provided. A driving connection assembly 43 extends through an opening 45 to an end surface 139 of in housing 51.

Figure 3:
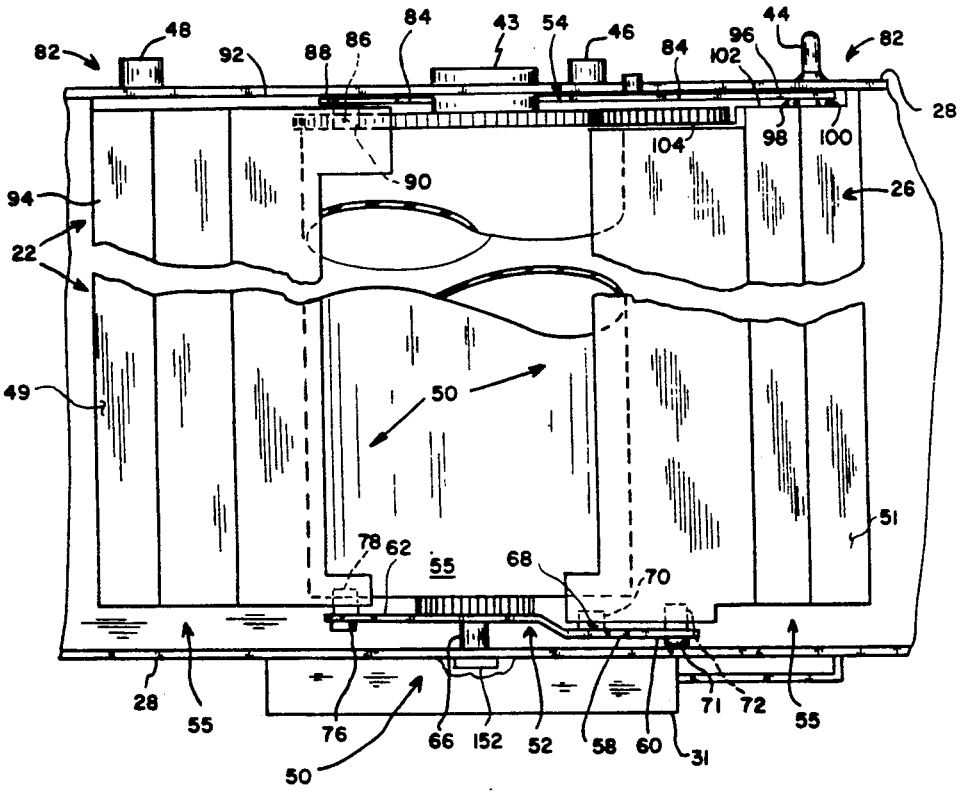
FIG. 3 is a partial inverted plan view of the photosensitive drum and support structure for pivotally mounting the developing device and the cleaning device on opposite sides of the drum in the process kit housing of FIG. 2. The view illustrates the underside of the assembly as mounted in the machine of FIG. 1.
Figure 4:
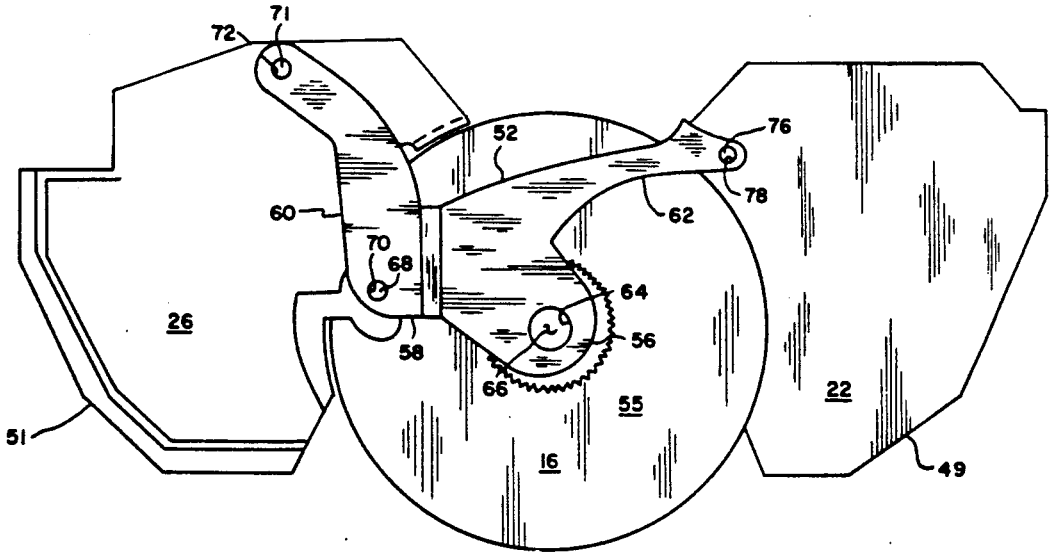
FIG. 4 is a rearward end elevational view (not inverted) illustrating the pivotal support means for the drum, the developing device, and the cleaning device of the present invention.
Figure 14:
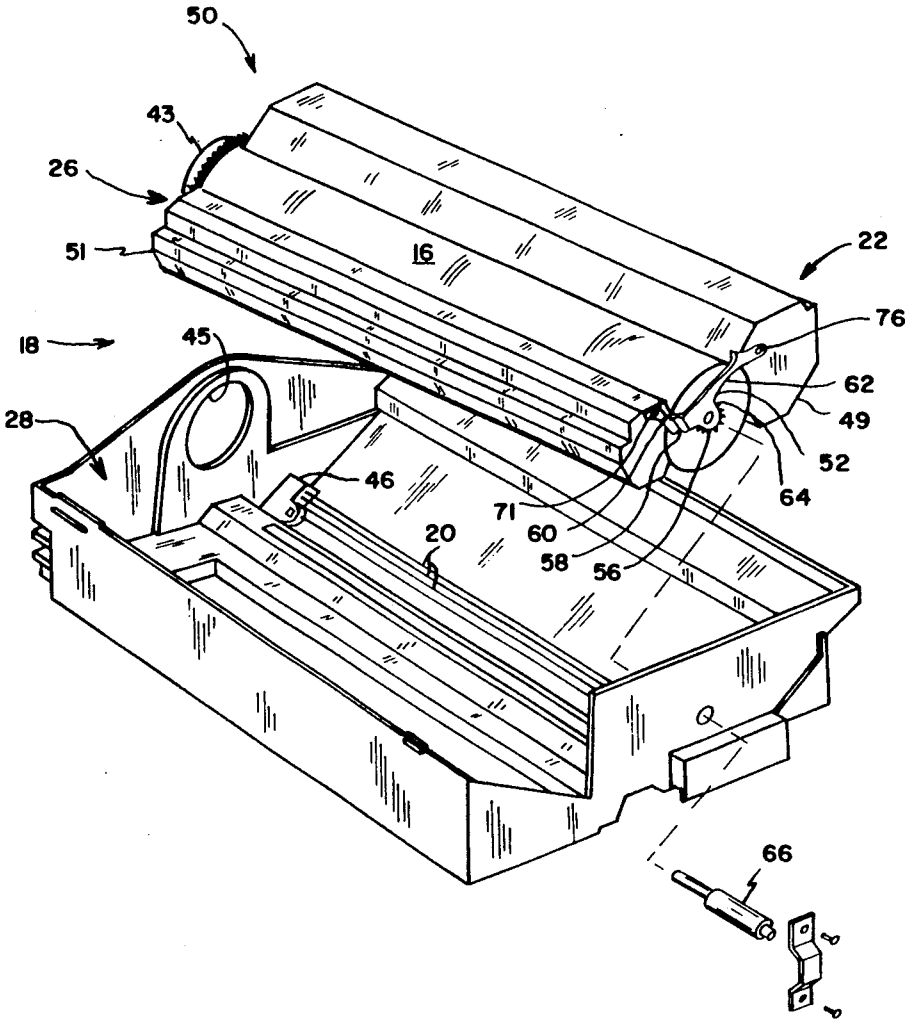
FIG. 14 is an exploded pictorial view of the primary housing and internal housing assembly of FIGS. 1 and 2 and illustrates the photosensitive drum, the developer housing, the cleaner housing, and one end bracket for releasably secured relation of the drum, the cleaner housing, and the toner housing. A corona discharger is shown mounted to the primary housing in a typical manner.

To provide for access into the process kit for servicing thereof by refurbishment or replacement of the internal components, including the development device 22, cleaning device 26, drum 16, and corona discharger 20, an inner housing assembly 50 is provided and includes a housing 49 of development device 22, a housing 51 of cleaning device 26, and a pair of end support members or brackets 52 and 54 (FIG. 3). Members 52 and 54 are disposed for removably supporting development device 22, cleaning device 26, and drum 16 in housing 28. Bracket 52 (FIGS. 3 and 4) is disposed at the forward end 55 of housing assembly 28, and, as seen in FIGS. 4 and 14, includes four legs 56, 58, 60, and 62. Leg 56 includes an opening 64 positioned around a stub shaft 66 of drum 16. Leg 58 includes a pin 68 which extends into an opening 70 on cleaning device 26, and leg 60 includes a pin 71 which extends into an opening 72 respectively, of housing 51 of cleaning device 26. Leg 62 is provided with a pin 76 which extends into an opening 78 of housing 49 of development device 22. Housing 49 of development device 22 is pivotally supported by pin 76.

Figure 5:
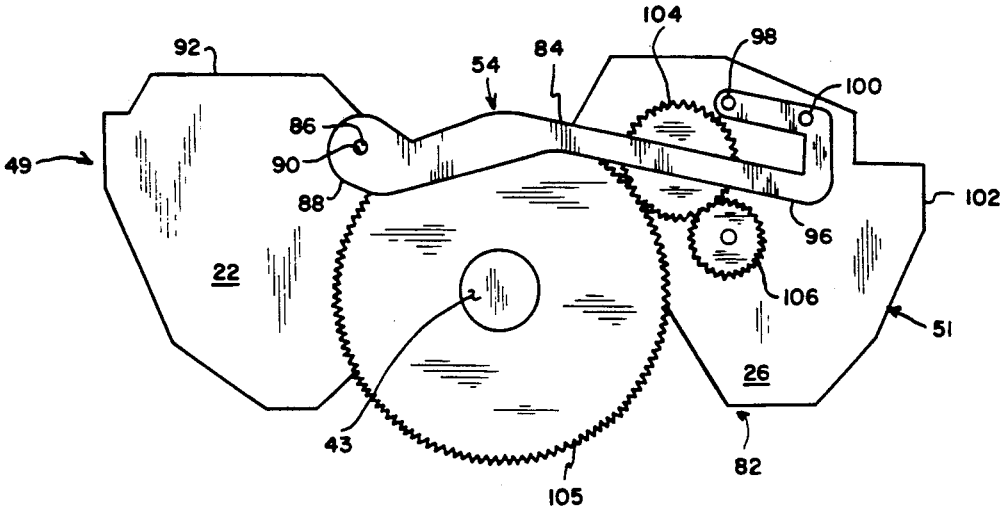
FIG. 5 is a forward end elevational view similar to FIG. 4 of the pivotal support means for the drum, the developing device, and the cleaning device of the present invention.

As can be seen in FIGS. 3 and 5, bracket 54 is releasably secured to the developing housing 49 and cleaner housing 51 and is positionable in the rearward end 82 of housing 28 and includes an arm 84 having a pin 86 disposed at one end 88 thereof. Pin 86 extends into an opening 90 provided in the rearward end 92 of housing 49 of development device 22. Housing 49 is pivotally mounted by pin 86. The second end 96 of arm 84 is rigidly secured by a pair of pins 98 and 100 (FIG. 5) to the rearward end 102 of housing 51. Arm 84 passes a pair of gears 104 and 106 which rotate a wiper arm in cleaning device 26 for cleaning residual toner on the drum, in a manner known in the art. Gear 104 engages a gear 105 mounted around the periphery of the drum. As the drum rotates, gear 105 drives gear 104 which, in turn, rotates gear 106 to rotate the wiper arm. Such structure is disclosed in U.S. Pat. No. 4,575,221.

FIG. 6 illustrates the positioning of the corona discharger 20 relative to drum 16. As seen in FIG. 6, the development device 22 includes housing 49, toner 108, and a plug 110 for retaining the toner in housing 49 of the developing device 22. Developing device 22 is shown to include a development sleeve 112 of non-magnetic material enclosing a magnetic roller 114. A magnetic blade 116 is also mounted in housing 49.

As also seen in FIG. 6, cleaning device 26 includes housing 51, a scraper blade 118, a scooping sheet 120, and a magnet 122. A plug 124 is provided for removal of the used toner from housing 51, if desired. Both the cleaning device and development devices are well known in the art. FIG. 14 illustrates a typical non-removable mounting of the corona discharger to housing 28; however, the corona discharger 20 may be mounted on cleaning housing 51 adjacent to and substantially along the length of the drum 16 for removal from housing 28 along with the removal of the cleaning housing 51. The corona discharger may be then individually removed from cleaner housing 51 as described below.

Figure 7:
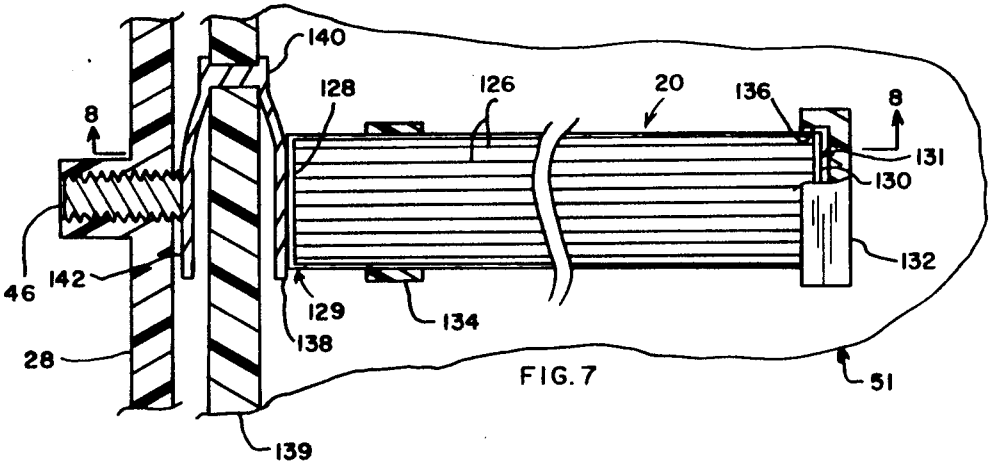
FIG. 7 is a partial plan view illustrating the manner in which the corona assembly is mounted in its housing.
Figure 8:
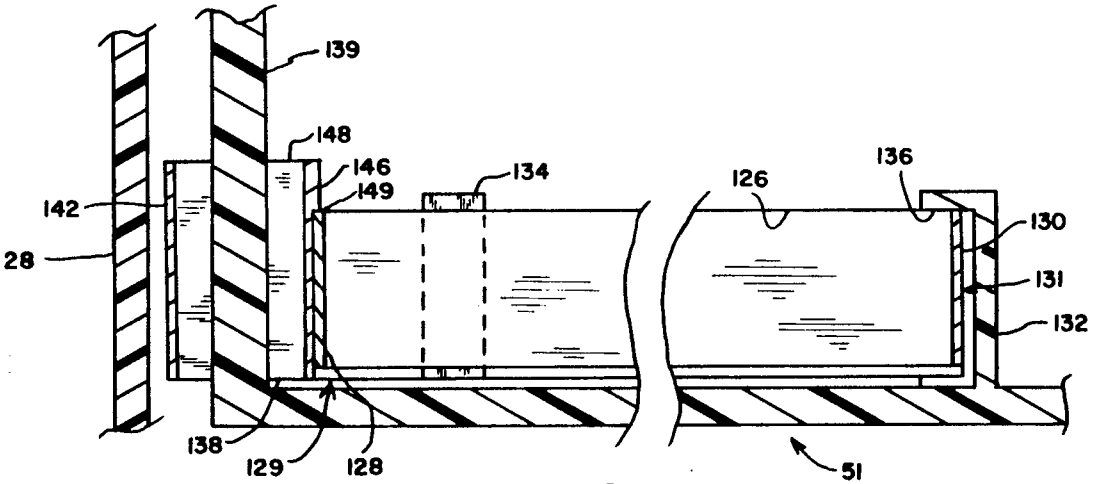
FIG. 8 is a sectional view taken along line 8—8 of FIG. 7.

FIGS. 7 and 8 illustrate a manner in which the corona discharger may be removably mounted in housing 51 to provide electrical contact with the printing machine's electrical connector. As seen in FIG. 7, corona 20 includes a plurality of substantially parallel conductors 126 connected to a pair of end conductive members 128 and 130. Corona 20 is positioned in a pair of brackets 132 and 134 molded in housing 51. Bracket 132 is provided with an opening 136 into which the end 131 of corona 20 is inserted and held. Bracket 134 maintains the proper alignment of the corona in housing 51 adjacent the forward end 129 of corona 20. To provide electrical contact with the electrical contact of the main machine, a first electrical resilient contact member 138 is secured in housing 51 by a conductive pin 140 and is disposed for engagement with end 129 of corona 20. Pin 140 extends through end surface 139 of housing 51 and has a second electrical resilient contact 142 secured thereto. Contact 142 is disposed for electrical contact with conductive screw 46 which is secured in housing 28 for electrical contact with the electrical source in the printer. To retain corona 20 in secured relation in brackets 132 and 134, contact member 138 may be provided with a protrusion 146 along its upper surface 148 for gripped engagement with an upper surface 149 of end member 128 of corona 20 (FIG. 8).

Similar electrical leaf spring connections may be provided between development device 22 and housing 28 to effect the necessary electrical connections between the printer and the development device.

Figure 9:
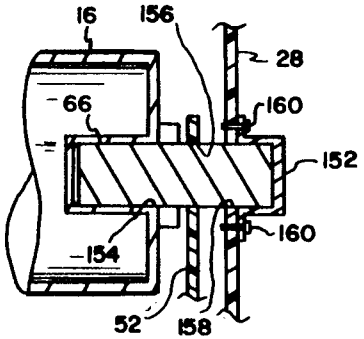
FIG. 9 is a partial sectional view illustrating a manner in which the stub shaft for the rotatable drum may be arranged. The bracket assembly of the internal housing has been removed for clarity.

As seen in FIG. 9, stub shaft 66 of drum 16 may be secured in the assembly by an end cap 152 which secures the shaft in an opening 154 of drum 16 and in openings 156 and 158 of bracket 52 and housing 28, respectively. Cap 152 is secured to housing 28 by screws 160.

Figure 11:
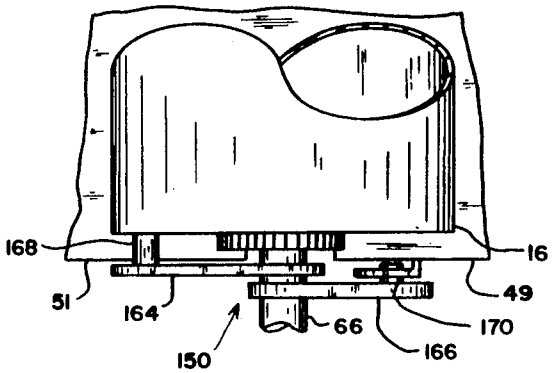
FIG. 11 is an elevational view taken along line 11—11 of FIG. 10.
Figure 12:
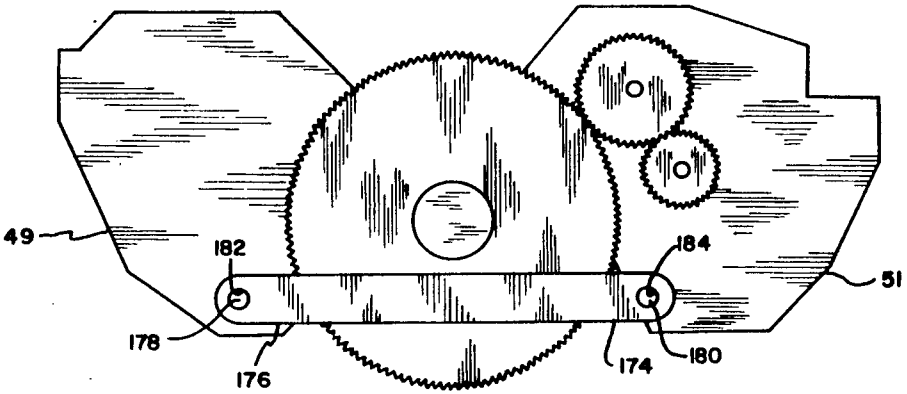
FIG. 12 is a view similar to FIG. 10 of another bracket which may be used at the rear end of the process kit assembly.
Figure 10:
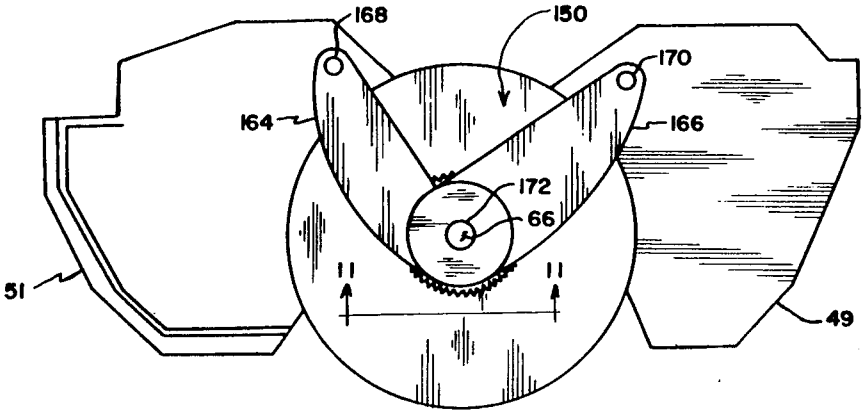
FIG. 10 is an elevational view illustrating another type of bracket which may be used at the forward end of the process kit assembly for pivotal movement of the developing device housing and the cleaning device and corona assembly housing.

FIGS. 10-12 illustrate other types of brackets which may be used in lieu of brackets 52 and 54, previously disclosed. As seen in FIGS. 10 and 11, a bracket 150 may be used instead of bracket 52. Bracket 150 is shown to include a pair of discrete legs 164 and 166 which are, respectively, releasably and pivotally secured to housings 51 and 49 by pins 168 and 170. An opening 172 is provided in the bracket for pivotally securing the bracket to shaft 66 of drum 16.

FIG. 12 illustrates a bracket 174 which may be used in lieu of bracket 54 and includes an arm 176 extending between housing 49 of developing device 22 and housing 51 of cleaning device 26. Arm 176 is provided with a pair of pins 178 and 180 which are releasably inserted in openings 182 and 184 of housings 49 and 51.

Figure 13:
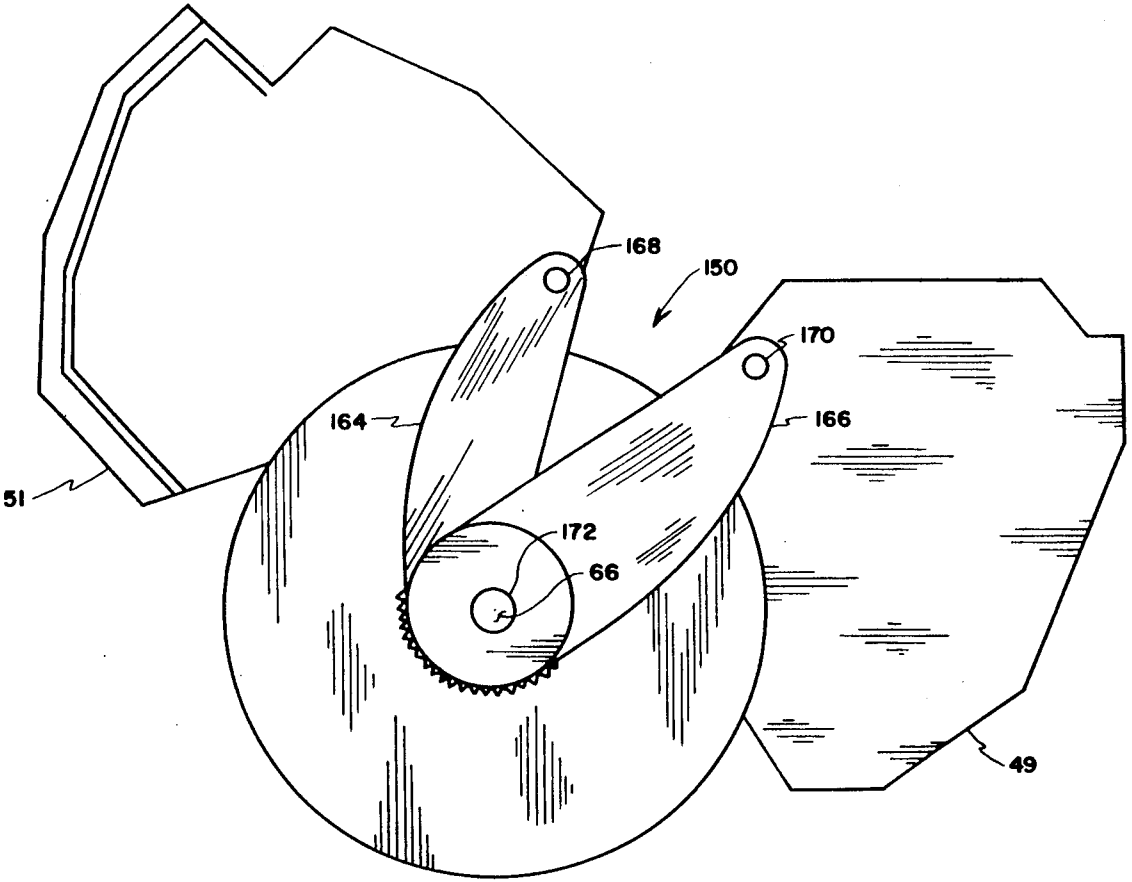
FIG. 13 is an end elevational view similar to FIG. 10 illustrating a housing section pivoted upwardly.

FIG. 13 is a view similar to FIG. 10 illustrating the cleaning housing 51 pivoted upwardly in an arc about the drum. Bracket 150 is pivoted on the shaft of the drum. Such pivoting movement is accomplished by removing pin 180 out of opening 184 on the opposite end of the housing to permit the housing 51 to be pivoted around the drum. Housing 49 may be pivoted in a similar manner.

Once the process kit is inserted in the printer, proper alignment is maintained by pin 44 (FIG. 2), and electrical contact is made through contacts 46 and 48. Also, driving connection to the drum is made through driving connection assembly 43 which extends through an opening 45 in housing 28. It is to be understood that while the corona assembly has been described as being mounted in cleaning device housing 51, it may be mounted in outer primary housing 28 as shown in FIG. 14 in a manner well known in the art such as disclosed in the aforementioned Patent No. 4,575,221. Or, if desired, the corona discharger may be mounted in a separate housing altogether. However, in accordance with the principles of the present invention, it is desirable that the corona assembly be releasably mounted.

It should be readily seen from the foregoing that the applicant has provided a process kit which is constructed to provide for fast and easy disassembly for servicing or individual replacement of the expendable components thereof. Such servicing and/or replacement provides for a much less expensive process kit than was previously obtainable since such previous process kits were intentionally made and sold as a unit whereby, if only one component of the kit were expended, then the user was required to purchase the entire kit instead of replacing or servicing only the expended item.

I claim:

1. A process kit for use in an image-forming apparatus comprising:

a primary housing disposed for being removably mounted in said image-forming apparatus in interfacing relation therewith and an inner housing assembly removably mountable in snug-fitting relation in said primary housing, said inner housing assembly comprising:

processing means comprising a plurality of processing components including at least a photosensitive drum disposed for having a latent image formed on the surface thereof, a first housing enclosing toner means for co-acting with said surface of said drum for the formation of the latent image thereon, a second housing enclosing a cavity for receiving excess toner from said drum, said first housing, said second housing, and said drum having first and second ends;

inner housing assembly support means disposed in releasably secured relation with said first and second housings and said photosensitive drum of said inner housing assembly to provide for removal of said inner housing assembly from said primary housing as a unit, whereby said inner housing assembly may be held away from said primary housing for removal of selected ones of said components from said inner housing assembly subsequent to removal of said primary housing from said image-forming apparatus, said photosensitive drum having first and second shafts, respectively, at said first and second ends thereof, first bracket means having a pair of relatively movable discrete arms provided with distal ends, said arms being rotatably mounted on said first shaft of said photosensitive drum with the distal ends of said arms being pivotally and releasably secured to the respective said first ends of said first and second housings to permit pivotal movement of said first and second housings relative to said drum; and means for releasably securing said first bracket means to said first and second housings and said photosensitive member.

2. Apparatus as set forth in claim 1 including second bracket means comprising an elongated member having distal ends, and means disposed on said distal ends for releasably securing said elongated member to said second ends of said first and second housings.

* * * * *